US008135149B2

(12) United States Patent
Yoshida et al.

(10) Patent No.: US 8,135,149 B2
(45) Date of Patent: Mar. 13, 2012

(54) WIRELESS COMMUNICATION DEVICE

(75) Inventors: Akihide Yoshida, Habikino (JP); Yoshio Sekiyama, Nishinomiya (JP)

(73) Assignee: Icom Incorporated, Osaka (JP)

( * ) Notice: Subject to any disclaimer, the term of this patent is extended or adjusted under 35 U.S.C. 154(b) by 1310 days.

(21) Appl. No.: 11/512,358

(22) Filed: Aug. 30, 2006

(65) Prior Publication Data

US 2007/0047747 A1 Mar. 1, 2007

(30) Foreign Application Priority Data

Aug. 31, 2005 (JP) ..... 2005-252129

(51) Int. Cl.
*H04R 25/00* (2006.01)

(52) U.S. Cl. ..... 381/189; 381/123; 381/150; 381/163; 381/164; 381/345; 381/347; 381/348; 381/355; 367/163; 367/174; 367/188; 455/23; 455/90.3; 455/575.1; 455/575.8

(58) Field of Classification Search ..... 381/189, 381/123, 150, 163, 164, 345, 347, 348, 355; 455/23, 90.3, 575.1, 575.8; 367/188, 163, 367/174

See application file for complete search history.

(56) References Cited

FOREIGN PATENT DOCUMENTS

| | | |
|---|---|---|
| JP | 59-81282 | 5/1984 |
| JP | 2000-201388 | 7/2000 |
| JP | 2000201388 A * | 7/2000 |

OTHER PUBLICATIONS

Notice of Reasons for Rejection issued Jul. 6, 2010 in counterpart application JP 2005-252129 (with partial English translation).

* cited by examiner

*Primary Examiner* — Vivian Chin
*Assistant Examiner* — Paul Kim
(74) *Attorney, Agent, or Firm* — Wenderoth Lind & Ponack, L.L.P.

(57) ABSTRACT

A wireless communication device includes a speaker grille, a built-in speaker provided behind the speaker grille, and an output amplifier connected to the built-in speaker. A voltage applied to the output amplifier is increased to a level higher than the level of voltage applied to the output amplifier while audio signals are being produced, and instead of the audio signals, low-frequency continuous signals are applied to the output amplifier. By increasing the voltage applied to the output amplifier to a level higher than the level of voltage applied to the output amplifier while audio signals are being produced, the amplitude of the voltage applied to the speaker is increased. Also, instead of the audio signals, low-frequency continuous signals are applied to the output amplifier so that the speaker produces a higher sound pressure than while audio signals are being produced to discharge water in the speaker grille under the sound pressure.

12 Claims, 4 Drawing Sheets

WIRELESS COMMUNICATION DEVICE

BACKGROUND OF THE INVENTION

The present invention relates to a waterproof, wireless communication device.

There are known waterproof, wireless communication devices having a speaker for producing sounds. These devices include a grille on the front side of the speaker to protect the speaker. Once such a communication device is submerged in water, water infiltrates into the grille, thus muffling the sound produced by the speaker. In the case of e.g. a wireless communication device mounted on a ship, it may be splashed with water according to the location where it is installed, or water may infiltrate into the grille while the interior of the ship is being cleaned with water. In either case, the communication device may become unable to produce sound.

That is, if a large amount of rainwater or seawater infiltrates into the front grille, such rainwater or seawater forms a film on the grids of the grille due to surface tension of water, thus muffling the sound produced the speaker. Therefore, in order to reuse the communication device, it is necessary to discharge water by lightly applying impacts to the communication device or drying it.

In order to avoid this problem, Unexamined JP patent Application KOUKAI publication 2000-201388 proposes, as shown in FIG. 5, to apply electrical signals of a predetermined frequency to an amplifier 2 from a low-frequency oscillating circuit 1 to activate a speaker 3. With this arrangement, the sound pressure produced when the speaker 3 is activated is used to directly remove foreign matter that has infiltrated into the device through a grille 4, or a waterproof film (foreign matter blocking film) 5 provided inside the grille 4 is vibrated at a resonance frequency to remove water and other foreign matter.

But in the arrangement in which the sound pressure produced when the speaker is activated is used to directly remove foreign matter in the grille, when foreign matter is gradually removed and the amount of foreign matter remaining in the grille decreases, the sound pressure tends to be released through gaps formed as a result of removal of foreign matter. Thus, it becomes impossible to apply sufficient sound pressure to the remaining foreign matter, so that foreign matter cannot be removed completely.

In the arrangement in which the waterproof film is vibrated at a resonance frequency, while it is possible to vibrate the waterproof film at a low sound pressure, because the vibration conducted to air in the grille from the speaker is conducted to the waterproof film, and sounds conduct to outside through the waterproof film, large energy is lost until sounds conduct to outside, so that no sufficient sound pressure is produced. Thus, water and other foreign matter cannot be removed efficiently.

SUMMARY OF THE INVENTION

An object of the present invention is to produce sufficient sound pressure to discharge water infiltrated into the speaker grille.

According to the present invention, a voltage applied to the output amplifier is increased to a level higher than the level of voltage applied to the output amplifier while audio signals are being produced, and instead of the audio signals, low-frequency continuous signals are applied to the output amplifier.

In this arrangement, by increasing the voltage applied to the output amplifier to a level higher than the level of voltage applied to the output amplifier while audio signals are being produced, the amplitude of the voltage applied to the speaker is increased. Also, instead of the audio signals, low-frequency continuous signals are applied to the output amplifier so that the speaker produces a higher sound pressure than while audio signals are being produced to discharge water under the sound pressure.

Preferably, the communication device further includes a timer for setting the time during which the high voltage is being applied to the output amplifier and the time during which the low-frequency signals are being applied to the output amplifier, thereby saving power consumption by stopping the water discharge function when a predetermined time period has passed.

Further preferably, the communication device includes a foreign matter blocking net disposed between the grille and the built-in speaker, the grille and the foreign matter blocking net defining a water discharge channel therebetween so that water can be discharged through the water discharge channel, thus further shortening the water discharge time.

The low-frequency signals are preferably produced by a program stored in a microprocessor so that the frequency can be easily changed by rewriting the program when e.g. the properties of the speaker or the volume of the interior of the grille changes.

With this arrangement, any water that has infiltrated into the speaker grille can be discharged by vibrating the speaker. Since water can be discharged by vibrating the speaker, if the communication device is dropped into water during communication, or if water infiltrates into the speaker grille under high water pressure, it is possible to resume communication in a short time.

BRIEF DESCRIPTION OF THE DRAWINGS

Other features and objects of the present invention will become apparent from the following description made with reference to the accompanying drawings, in which.

DETAILED DESCRIPTION OF THE INVENTION

Now the embodiment of the present invention is described with reference to the drawings.

Figure 1:
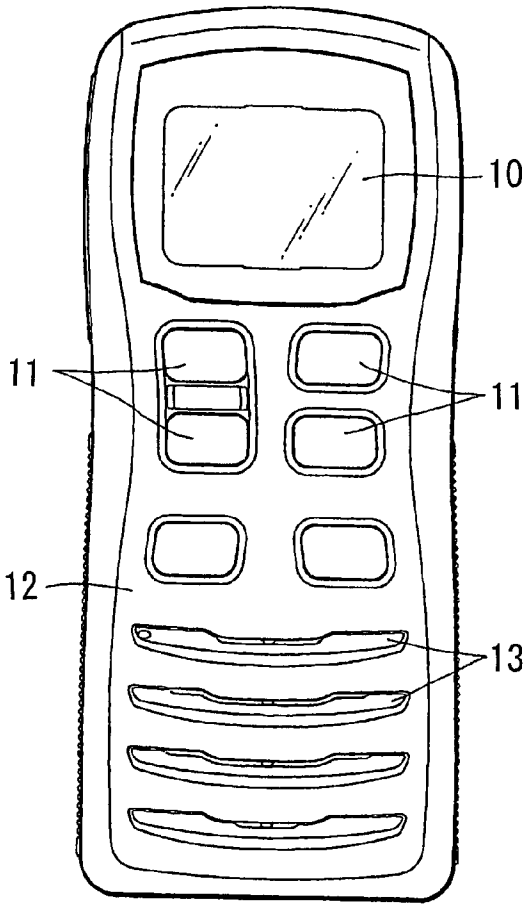
FIG. 1 is a front view of an embodiment according to the present invention.

As shown in FIG. 1, the wireless communication device of the embodiment includes a front panel 12 having a liquid crystal display 10 and operating switches 11. The front panel 12 further includes a speaker grille 13 at its lower portion.

Figure 2:
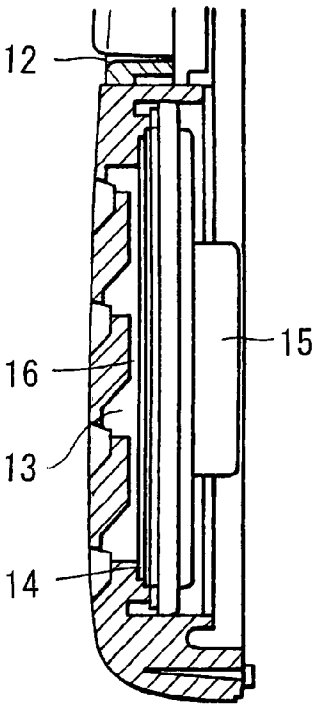
FIG. 2 is a partial enlarged sectional view of FIG. 1.

The speaker grille 13 comprises a plurality of transverse slits. As shown in FIG. 2, each slit extends obliquely downwardly toward the front surface of the front panel 12 to minimize infiltration of water into the device. A microphone or an external speaker can be connected to the device.

As shown in FIG. 2, inside the speaker grille 13, a foreign matter blocking net 14 is provided. Further behind the net 14, an internal speaker 15 is mounted.

Between the grille 13 and the foreign matter blocking net 14, a longitudinal space is defined as a water discharge channel 16.

Figure 3:
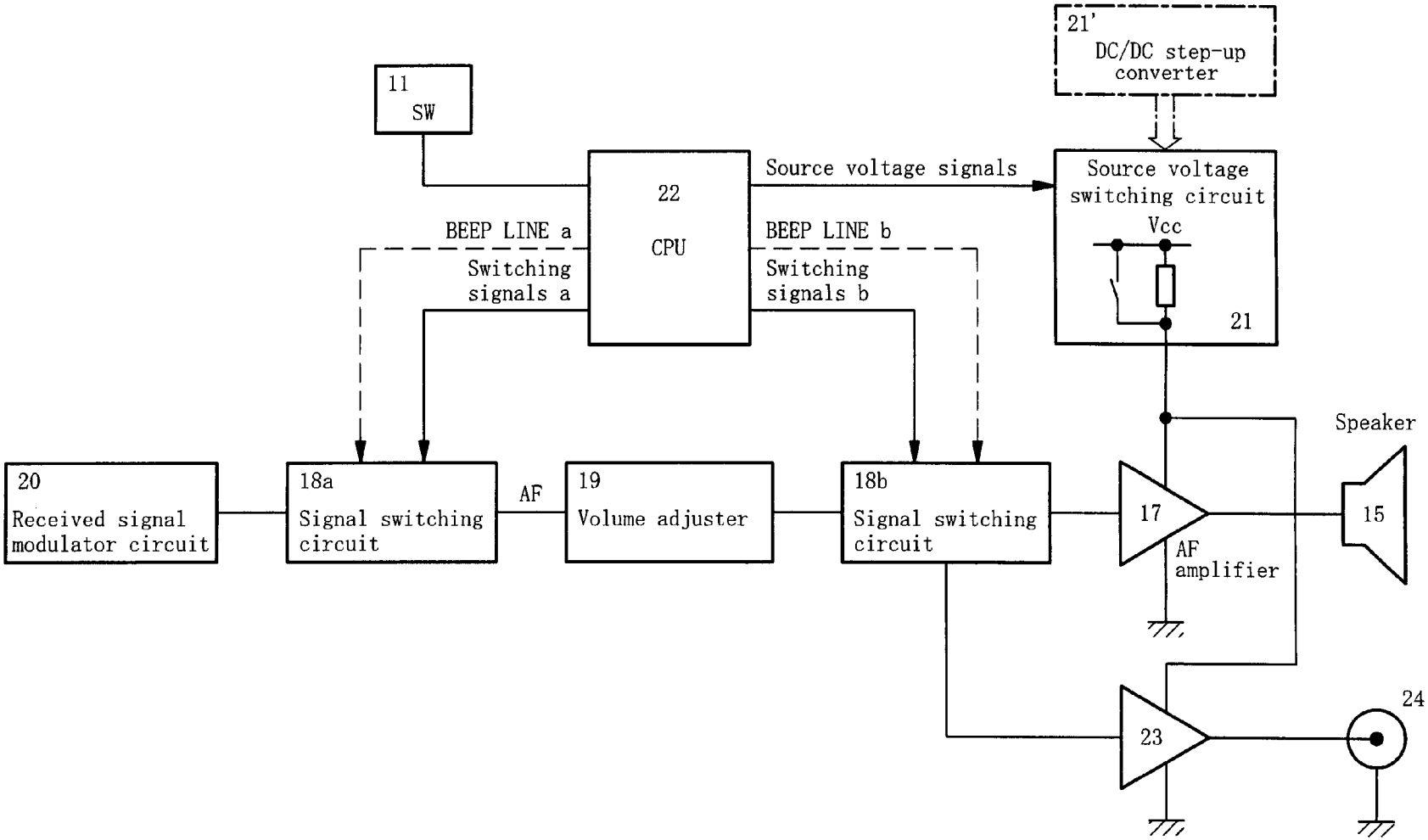
FIG. 3 is a block diagram of the embodiment of FIG. 1.

The speaker 15 is of the waterproof type and is connected to an AF amplifier 17 as shown in FIG. 3. The AF amplifier 17 is connected to a signal switching circuit 18*b* and a source voltage switching circuit 21. The signal switching circuit 18*b* is connected to a volume adjuster 19, which is connected to a signal switching circuit 18*a*. which is in turn connected to a received signal modulator circuit 20. The source voltage switching circuit 21 and the signal switching circuits 18*a* and 18*b* are connected to a CPU (microcomputer) 22. The CPU 22 is also connected to the operating switches 11.

The AF amplifier 17 is an audio amplifier for activating the speaker 15.

Depending on whether or not an water discharge assisting function to be described later is being activated, the signal switching circuit 18*b* selectively applies signals from the volume adjuster 19 or water discharge signals (BEEP LINE b) from the CPU 22 to the AF amplifier 17.

An AF amplifier 23 for external output is also connected to the signal switching circuit 18*b*. If an external speaker or earphone is connected to an external output terminal 24, the received modulated signals are applied to the AF amplifier 23 for external output. The AF amplifier 23 is connected to the source voltage switching circuit 21 so that a source voltage can be supplied according to the output of the external speaker or earphone.

The volume adjuster 19 adjusts the volume of the signals (audio signals) received from the received signal modulator circuit 20. In the embodiment, as shown in FIG. 3, the volume adjuster 19 is provided upstream (with respect to the flow direction of signals) of the signal switching circuit 18*b* so that the water discharge signals do not pass through the volume adjuster 19. With this arrangement, the water discharge signals are applied to the signal switching circuit 18*b* at a constant level irrespective of the volume determined by the volume adjuster 19.

The signal switching circuit 18*a* selectively applies signals from the received signal modulator circuit 20 or BEEP signals (BEEP LINE a) from the CPU 22 to the volume adjuster 19. The BEEP signals (BEEP LINE a) are used e.g. as operating sounds.

The received signal modulator circuit 20 comprises a signal receiving circuit and a modulating circuit. It modulates received signals and applies the thus modulated audio signals to the volume adjuster 19.

The source voltage switching circuit 21 switches over the source voltage applied to the AF amplifier 17 depending on whether or not water discharge assisting function is being activated. In this type of communication devices, 7 V is applied to communication lines and 5 V is applied to other lines, i.e. control lines and audio lines. In the embodiment, the 7 V battery output supplied to the communication lines is divided and supplied to the control lines and the audio lines. That is, ordinarily, source voltage of 5 V is applied to the AF amplifier 17 through a voltage dividing circuit of the source voltage switching circuit 21, which is shown schematically in FIG. 3. When the water discharge assisting function is activated, source voltage of 7 to 8 V is applied to the AF amplifier 17 through a switching circuit of the source voltage switching circuit 21 while bypassing the voltage dividing circuit. Thus, while the water discharge assisting function is being activated, the output of the speaker 15 increases to about 1.8 to 2.0 W from about 0.8 W while the speaker 15 is producing normal audio outputs. Thus, by increasing the source voltage applied to the AF amplifier 17, it is possible to increase the output of the speaker 15, thus increasing the sound pressure.

Instead of the switching circuit for bypassing the voltage dividing circuit, the source voltage switching circuit 21 may include a step-up circuit 21' (such as a charge pump) to apply high voltage to the AF amplifier 17 while the water discharge assisting function is being activated. This arrangement is advantageous in that it is possible to apply high voltage to the AF amplifier 17 even if the voltage applied to the communication lines is equal to the voltage applied to the control lines and audio lines. Needless to say, the speaker has to be capable of withstanding the high output produced.

The CPU 22 controls communication and operations of the switches, and also controls the source voltage switching circuit 21 to switch over the source voltage to be applied to the AF amplifier 17 depending on whether or not the water discharge assisting function is being activated. Specifically, the CPU 22 increases the source voltage applied to the AF amplifier 17 when the water discharge assisting function is activated.

The CPU 22 also controls the signal switching circuits 18*a* and 18*b* to switch over signals to be applied to the AF amplifier 17. Specifically, the CPU 22 controls the signal switching circuits 18*a* and 18*b* to selectively apply to the AF amplifier 17 audio signals transmitted from the received signal modulator circuit 20 through the volume adjuster 19 or the water discharge signals produced from the CPU 22 itself (e.g. low-frequency (about 200 Hz) signals such as beep sounds: the frequency of these signals is determined according to the characteristics of the speaker, volume of the interior of the grille 13, shape of the communication device, etc.).

The CPU 22 includes a built-in timer for stopping the water discharge function. The timer starts when the water discharge function starts and a predetermined time after the start, the CPU 22 switches over the source voltage switching circuit 21 to the original normal position.

The CPU 22 performs such control based on a control program stored therein. Thus, by rewriting such a program, it is possible to adjust the frequency of the water discharge signals and the duration of the timer to optimum values according to the volume of the speaker 15 or the interior of the speaker grille 13 used.

The operating switches 11 comprise a plurality of number and/or symbol keys such as Ctrl and Hi/Lo keys. Only when these plurality of keys are pressed in a proper order or simultaneously, the water discharge assisting function is started by the CPU 22. With this arrangement, it is possible to prevent untimely activation of the water discharge assisting function by erroneously pressing a single key.

Figure 4:
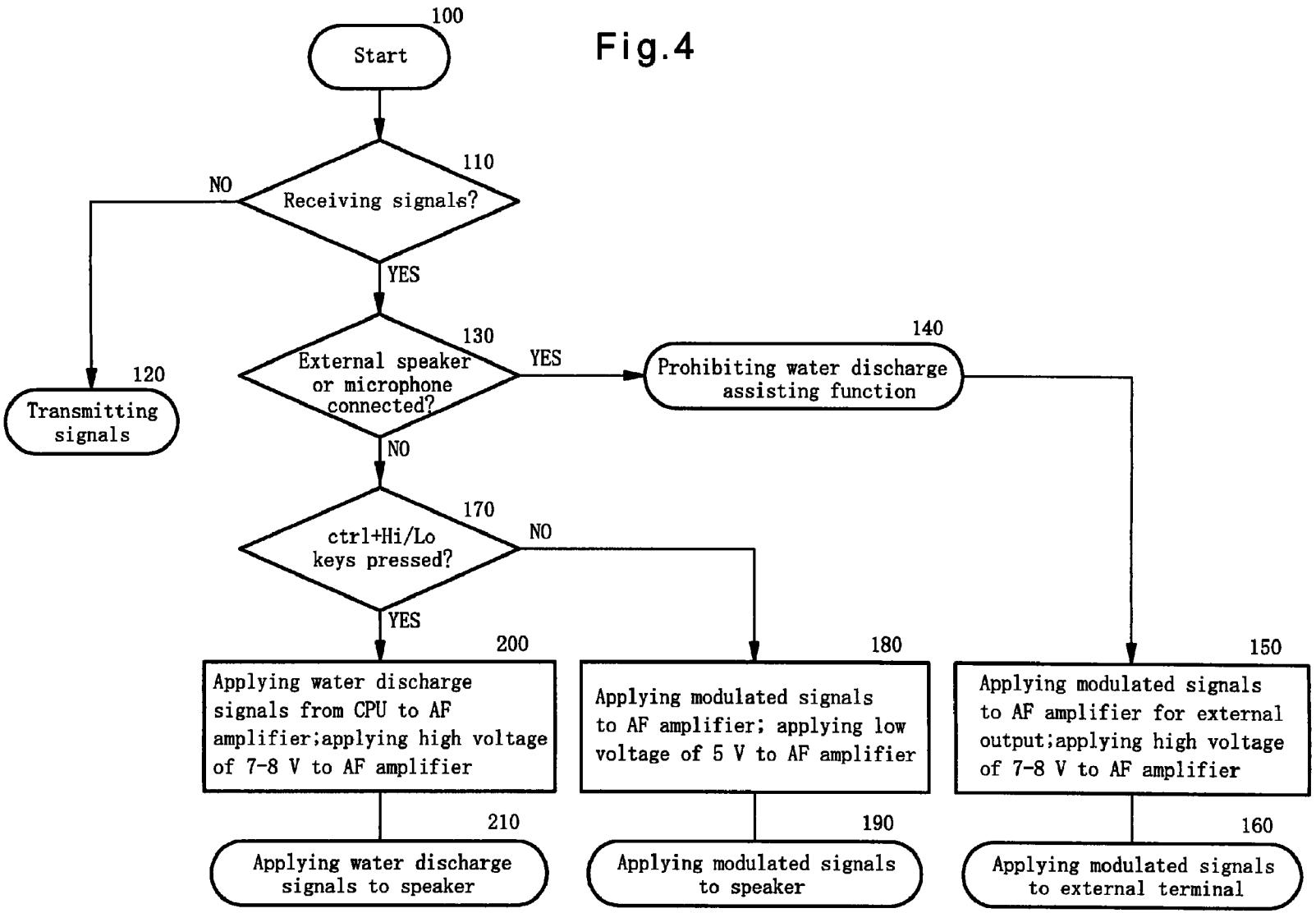
FIG. 4 is a flowchart of the embodiment.
Figure 5:
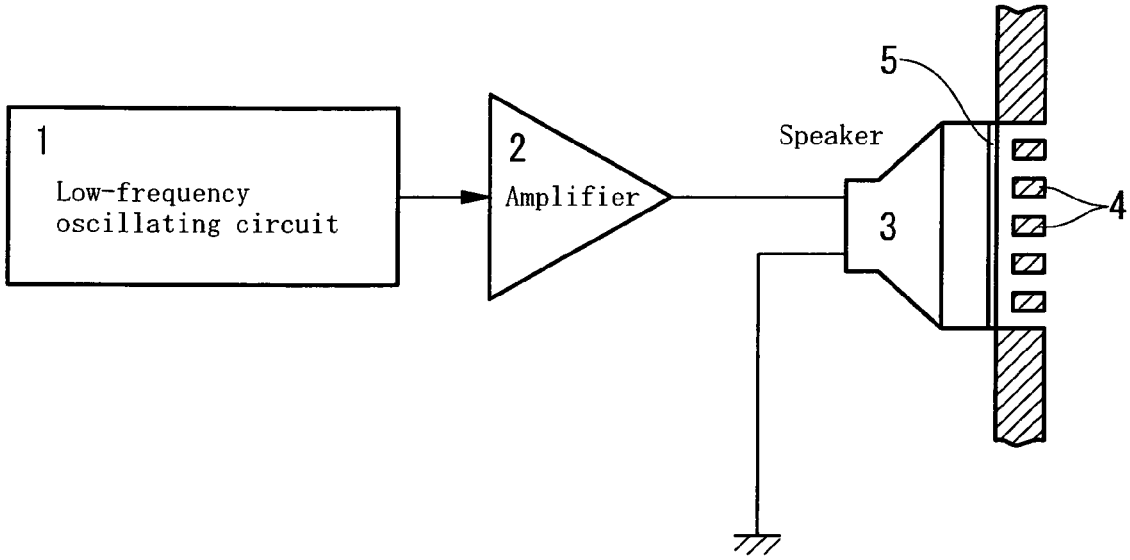
Fig.5 Prior Art
FIG. 5 is a block diagram of a conventional communication device.

The water discharge assisting function is now described with reference to the flowchart of FIG. 4.

If the communication device is submerged in water, a user switches on the communication device (Step 100). The CPU 22 then determines whether the communication device is receiving signals (Step 110). If the communication device is not receiving signals, the CPU 22 determines that the communication device is transmitting signals (Step 120).

If the CPU 22 determines that the communication device is receiving signals in Step 110, the CPU 22 now determines whether an external speaker or microphone is connected (Step 130). If an external speaker or microphone is connected, the CPU 22 prohibits the water discharge assisting function (Step 140), controls the source voltage switching circuit 21 to switch over the source voltage to be applied to the AF amplifier 17 to a high voltage (about 7 to 8 V) during water discharge, and then switches over the signal switching circuits 18*a* and 18*b* to apply the modulated signals from the received signal modulator circuit 20 to the AF amplifier 23, and then to the external output terminal 24 (Step 160).

If the CPU 22 determines that no external speaker or microphone is connected in Step 130, the CPU 22 determines whether the keys have been operated to activate the water discharge assisting function (Step 170). If the keys have not been operated, the CPU 22 controls the source voltage switching circuit 21 to switch over the source voltage to be applied to the AF amplifier 17 to a voltage during normal communication (e.g. 5 V), and then applies the output signals of the received signal modulator circuit 20 to the AF amplifier 17 through the signal switching circuits 18*a* and 18*b* (Step 180), and then to the internal speaker (Step 190).

If the CPU 22 determines that the keys have been operated in Step 170, the CPU 22 controls the source voltage switching circuit 21 to switch over the source voltage to be applied to the AF amplifier 17 to a high voltage during water discharge (e.g. about 7 to 8 V), and then switches over the signal switching circuits 18*a* and 18*b* to apply low-frequency signals such as BEEP sounds for water discharge to the AF amplifier 17 from the CPU 22 (Step 200), thereby driving the speaker 15 with the low-frequency signals (Step 210).

In this state, part of water that has infiltrated between the front surface of the diaphragm of the speaker 15 and the grille 13 is discharged through the discharge channel 16 formed in the grille 13 by moving the body of the communication device. Specifically, part of water remaining in curved recesses of the diaphragm or present on the foreign matter blocking net 14 in the form of a film due to surface tension is discharged. When the water discharge assisting function is activated and the speaker 15 is activated as a result, the sound pressure of the speaker 15 causes water to be blown out through the grille 13.

Immediately after the water discharge assisting function has been activated, because the space in the grille 13 is filled with water, the BEEP sounds as the water discharge signals remain inaudible, though water is being discharged. When water is completely discharged, the water discharge signals become gradually audible. 9 to 10 seconds after the water discharge signals become audible, the timer in the CPU 22 will be up and the BEEP sounds stop automatically. Thus, if the BEEP sounds are heard while the timer is running, the user can determine that water has been completely discharged.

According to the present invention, during water discharge, the source voltage applied to the AF amplifier 17 is increased, and low-frequency signals are applied thereto, so that it is possible to apply higher (twice or more) sound pressure to water that has infiltrated into the grille than the sound pressure during communication. Water can thus be discharged effectively.

In the embodiment, since the volume adjuster 19 is provided between the signal switching circuits 18*a* and 18*b*. while the water discharge assisting function is being activated, the water discharge signals are applied to the AF amplifier 17 without passing through the volume adjuster 19, amplified in the AF amplifier 17, and applied to the speaker 15. Thus, irrespective of the volume of the sounds received, the volume of the water discharge signals remain constant, so that there will be no fall in the water discharge capacity even if the user operates wrong keys.

Because high sound pressure is produced, water can be discharged even if the body of the communication device is horizontally positioned. For example, it is possible to discharge water with the communication device placed flat on a table in a shaking ship.

If the communication device is not used for a long period of time, by periodically activating the water discharge assisting function, it is possible to activate the speaker 15, thereby retarding aging of the speaker.

While the embodiment relates to a portable communication device, it will be needless to say that the water discharge function according to the present invention is equally applicable to stationary communication devices. That is, by mounting the circuit shown by the block diagram of FIG. 3 in a stationary communication device, it is possible to discharge water in the speaker grille of such a stationary communication device as equally effectively as in the case of the above-described embodiment.

Various modifications and changes may be made to the embodiment without departing from the broad spirit and scope of the invention. The above-described embodiment is intended to merely illustrate the present invention, not to limit the scope of the present invention. The scope of the present invention is defined by the attached claims and not by the embodiment. Various modifications made within the meaning of the equivalent of the claims of the invention and within the claims are to be regarded to be in the scope of the present invention.

What is claimed is:

1. A wireless communication device, comprising:
a speaker that produces sound;
a speaker grille provided in front of the speaker;
an output amplifier connected to the speaker;
a source voltage switching unit that switches a level of voltage applied to the output amplifier;
a signal switching unit that switches an output of the output amplifier to an audio signal or a water discharge signal; and
a control unit that activates a water discharge assisting function,
wherein when the water discharge assisting function is activated, the control unit is configured to control the source voltage switching unit to apply a first voltage to the output amplifier, the first voltage being higher than a second voltage applied to the output amplifier while the audio signal is being produced, and to control the signal switching unit to continuously apply the water discharge signal to the output amplifier so that the speaker produces a higher sound pressure than while the audio signal is being produced, thereby discharging water in the speaker grille.

2. The wireless communication device of claim 1, wherein the control unit includes a timer for setting a time period during which the first voltage is applied to the output amplifier, and a time period during which the water discharge signal is continuously applied to the output amplifier.

3. The wireless communication device of claim 1, wherein the water discharge signal is a continuous low-frequency signal.

4. The wireless communication device of claim 1, further comprising a foreign matter blocking net disposed between the speaker and the speaker grille, the foreign matter blocking net and the speaker grille defining a water discharge channel therebetween.

5. The wireless communication device of claim 1, wherein the water discharge signal is produced by a program stored in the control unit.

6. The wireless communication device of claim 3, wherein the continuous low-frequency signal is produced by a program stored in the control unit.

7. A wireless communication device, comprising:
a speaker that produces sound;
a speaker grille provided in front of the speaker;
an output amplifier connected to the speaker;
a volume adjuster that adjusts a volume of an audio signal received;
a water discharge signal generator that generates a water discharge signal of a predetermined voltage;
a control unit that activates a water discharge assisting function; and a signal switching circuit configured to receive an output of the volume adjuster and an output of the water discharge signal generator, the signal switching unit also being configured to apply one of the output of the volume adjuster and the output of the water discharge signal generator to the output amplifier according to a switching signal from the control unit, wherein when the water discharge assisting function is activated, the control unit is configured to activate the water discharge signal generator and simultaneously control the signal switching circuit to apply the output signal from the water discharge signal generator to the output amplifier, thereby vibrating the speaker based on the water discharge signal of a predetermined volume regardless of the volume of the audio signal adjusted by the volume adjuster, and discharging water in the speaker grille.

8. The wireless communication device of claim 7, wherein the control unit includes a timer for setting a time period during which the water discharge signal is continuously applied to the output amplifier.

9. The wireless communication device of claim 7, wherein the water discharge signal is a continuous low-frequency signal.

10. The wireless communication device of claim 7, further comprising a foreign matter blocking net disposed between the speaker and the speaker grille, the foreign matter blocking net and the speaker grille defining a water discharge channel therebetween.

11. The wireless communication device of claim 7, wherein the water discharge signal is produced by a program stored in the control unit.

12. The wireless communication device of claim 9, wherein the continuous low-frequency signal is produced by a program stored in the control unit.

* * * * *